US007191716B2

(12) United States Patent
Dixon et al.

(10) Patent No.: US 7,191,716 B2
(45) Date of Patent: Mar. 20, 2007

(54) AUTOMATIC TUFTING METHOD AND APPARATUS THEREFOR

(76) Inventors: Howard Martin Dixon, 7 Chestnut Drive, Balladen, Rawtenstall, Rossendale, Limburgerhof (GB) BB4 6DP; Paul Rodgers, 22 Greave Clough Drive, Bacup, Lancashire (GB) OL13 9HP ( * ) Notice: Subject to any disclaimer, the term of this patent is extended or adjusted under 35 U.S.C. 154(b) by 68 days.

(21) Appl. No.: 10/918,126

(22) Filed: Aug. 13, 2004

(65) Prior Publication Data

US 2005/0034643 A1 Feb. 17, 2005

(30) Foreign Application Priority Data

Feb. 14, 2002 (GB) ..... 0203495.7
Sep. 21, 2002 (GB) ..... 0221967.3

(51) Int. Cl.
*D05B 3/22* (2006.01)

(52) U.S. Cl. ..... 112/80.01

(58) Field of Classification Search ..... 29/91.2; 112/2.2, 2.1, 9, 80.01, 80.03, 80.04
See application file for complete search history.

(56) References Cited

U.S. PATENT DOCUMENTS 2,855,878 A * 10/1958 Bronstien, Jr. et al. ..... 112/2.2
2,920,588 A * 1/1960 Bronstien, Jr. et al. ..... 112/2.2
4,368,566 A * 1/1983 Miller ..... 29/91.4
4,795,073 A * 1/1989 Yamamoto et al. ..... 227/120
6,032,345 A * 3/2000 Resta ..... 29/91.4
6,634,307 B2 * 10/2003 Resta ..... 112/2.2
6,718,894 B2 * 4/2004 Whaley ..... 112/470.27
6,804,940 B2 * 10/2004 Resta ..... 53/521

FOREIGN PATENT DOCUMENTS

| | | |
|---|---|---|
| EP | 0 844 210 A2 | 5/1998 |
| EP | 1 167 279 A2 | 1/2002 |
| FR | 2 462 603 | 2/1981 |
| GB | 2 254 001 A | 9/1992 |
| GB | 2 282 756 A | 4/1995 |

* cited by examiner

*Primary Examiner*—Danny Worrell
(74) *Attorney, Agent, or Firm*—Woodard, Emhardt, Moriarty, McNett & Henry LLP

(57) ABSTRACT

The present invention relates to a method and apparatus for the automatic insertion of an individual upholstery tuft (3) and washer (1) from a plurality of connected tufts (4) and a plurality of connected washers (2) into an upholstered article. The apparatus has a cutting blade (35) to separate an individual tuft (3) from the plurality of connected tufts (4). The turf (3) is then engaged by a pair of arms (27, 28) and fed into a tuft insertion needle (14). The arms are connected to automatic washer feed apparatus which feeds an individual washer (1) from the plurality of connected washers (2) and aligns it with the tuft insertion needle (14) ready for insertion. The insertion needle (14) is pneumatically actuated to force the tuft (3) through the washer (1), into the upholstered article, release the tuft (3) and subsequently withdraw the needle (14) from the article.

37 Claims, 8 Drawing Sheets

AUTOMATIC TUFTING METHOD AND APPARATUS THEREFOR

CROSS REFERENCE TO RELATED APPLICATIONS

The present Application claims foreign priority benefits of International Patent Application Number PCT/GB03/00573 filed Feb. 7, 2003, which claims the benefit of British Patent Application Number 0203495.7 filed Feb. 14, 2002 and of British Patent Application Number 0221967.3 filed Sep. 21, 2002, the contents of each application hereby being incorporated by reference in their entirety.

FIELD OF THE INVENTION

The present invention relates to automatic upholstery tufting methods and apparatus therefor, particularly but not exclusively, for tufting such articles as mattresses, cushions and the like.

BACKGROUND

Tufting is widely used to support and strengthen upholstered articles, such as mattresses. Approximately 40% of all mattresses sold in the United Kingdom in 2001 were tufted.

Tufting typically involves the insertion of an elongate flexible element such as a tape or string interconnecting a pair of toggles (the whole hereinafter referred to as a "tuft") through a mattress so that one toggle resides on either side of the mattress. The mattress is usually compressed during insertion of the tuft and allowed to expand once the tufting process has been completed. Since the length of the tuft is marginally less than the depth of the mattress, the region of the mattress near the tuft remains slightly compressed following expansion of the mattress after insertion.

It is common for a washer, often made of felt or a similar compressible material, to be located intermediate the toggle and the outer surface of mattress on each side of the mattress. Such washers reduce wear caused by rubbing of toggles over the surface of the mattress and prevent toggles from being pulled into the mattress. A further advantage of using washers is that, due to their compressible nature, each toggle can sink down into its associated washer thereby reducing the extent to which the toggle protrudes from the mattress surface thus increasing the aesthetic appeal and comfort of the mattress.

The tufting process is normally carried out manually by a worker standing adjacent a mattress with a tuft insertion needle and a series of separate tufts and washers. A tuft and washer are loaded onto the needle, the needle forced through the mattress and subsequently withdrawn to be reloaded ready for insertion of the next tuft. The washer loaded onto the needle remains on the side of the mattress nearest the worker. A second washer must then be manually inserted in between the toggle and the surface of mattress on the opposite side of the mattress. The process is therefore slow, labor intensive and inefficient. Furthermore, the repetitive nature of the work has lead to some workers developing repetitive stress injury (RSI).

There have recently been attempts to automate parts of the tufting process. European Patent Application No. EP0844210A2 (RESTA S.R.L) discloses an apparatus for fitting quilting braces, or tufts, to mattresses. A tuft insertion needle is supported on a frame to one side of the mattress and a string of washers is supported in a channel aligned with the needle on the opposite side of the mattress. A pneumatic jack is used to force the needle (with a tuft and washer loaded) through the mattress and into the leading washer of the string. The tuft is released from the needle, the needle retracted and the leading washer from the string drawn against the side of the mattress. While this apparatus goes someway towards automating the tufting process, individual tufts and washers must be manually loaded onto the needle each time a tuft is to be inserted, significantly reducing the efficiency of the process.

A further attempt to automate the tufting process is disclosed in European Patent Application No. EP1167279A2 (WHALEY). A device and method are described for tufting upholstery units using individual tufts automatically separated from a continuous string of tufts each time one is to be inserted. Reference is made to a support (i.e., a washer) feed means. From FIG. 15 of this document it appears that individual washers are fed, possibly under gravity, to the insertion needle. Since washers are typically made from a soft, flexible material, such as felt, it will be readily apparent to those skilled in the art that in order to overcome the practical difficulties inherent in individually feeding such washers a great deal of technical expertise would be required. However, since very few technical details are provided it is unclear exactly how this feature surmounts these problems and contributes to improving the efficiency of the overall tufting process.

An object of the present invention is therefore to provide a more efficient method of automatically tufting an upholstered article. A further object of the present invention is to provide a method of automatically feeding individual upholstery washers to an upholstery tufting apparatus so as to increase the efficiency of tufting an upholstered article.

There is a general need in the industry to provide an improved tufting method and apparatus. The present invention satisfies this need and provides other benefits and advantages in a novel and unobvious manner.

SUMMARY

The present invention relates generally to an automatic tufting method and apparatus therefor. While the actual nature of the invention covered herein can only be determined with reference to the claims appended hereto, certain forms of the invention that are characteristic of the preferred embodiments disclosed herein are described briefly as follows.

According to a first aspect of the present invention, there is provided an apparatus for automatically feeding an individual upholstery washer to upholstery tufting apparatus comprising, a washer guide along which a plurality of connected washers can be fed towards a tuft insertion needle of the tufting apparatus, washer engagement means to engage at least one of the connected washers, feed the washers along the guide and align a leading washer with the insertion needle, and a washer separator to separate the leading washer from the plurality of connected washers. Feeding of a plurality of washers using apparatus in this way enables individual washers to be located on to tuft insertion needles accurately and reliably which in turn greatly increases the efficiency of the overall tufting process.

According to a second aspect of the present invention there is provided a method for automatically feeding an individual upholstery washer to an upholstery tufting apparatus comprising the steps of providing a plurality of connected washers, engaging at least one of the plurality of connected washers in a washer guide with washer engagement means, feeding the connected washers along the washer guide towards an insertion needle of the upholstery tufting apparatus, aligning a leading washer with the insertion needle, and separating the leading washer from the plurality of connected washers.

Preferably the washer separator has a cutting blade and is actuated by the tufting apparatus. The washer engagement means preferably has at least one projection to engage at least one of the connected washers. The or each projection may be received in an aperture in one of the connected washers.

Preferably the washer guide comprises a first member slidably received on a second member. The washer engagement means is preferably connected to the first member such that sliding of the, first member over the second member towards the insertion needle causes the plurality of connected washers to be fed along the washer guide towards the insertion needle. The washer engagement means may be pivotally connected to the first member. The second member preferably has a ramp over which the washer engagement means passes when the first member slides over the second member away from the insertion needle. Preferably the first member is connected to the second member by biasing means which biases the first member away from the insertion needle. Sliding of the first member over the second member towards the insertion needle is preferably pneumatically actuated. Preferably the insertion needle and the tufting apparatus are pneumatically actuated.

According to a third aspect of the present invention there is provided a plurality of upholstery washers for use with upholstery tufting apparatus, wherein each washer is connected to at least one further washer.

Preferably each of the plurality of washers is connected to at least one further washer in a side-by-side fashion. The washers may be made from a compressible material which may be a felt material. Preferably at least one of the plurality of washers has an aperture for receipt of an upholstery tuft.

According to a fourth aspect of the present invention there is provided apparatus for the automatic insertion of an individual upholstery tuft and washer comprising, means for feeding a plurality of connected tufts and means for feeding a plurality of connected washers, first tuft engagement means to engage a leading tuft and feed it to a tuft insertion needle, the first engagement means being reversibly movable from a rest position clear of the needle and an insertion position where it inserts the leading tuft into the insertion needle, a washer separator for separating a leading washer from the plurality of connected washers, a tuft separator for separating the leading tuft from the plurality of connected tufts, and means for driving the insertion needle and associated tuft through the separated leading washer, into the upholstered article, releasing the tuft from the needle and subsequently withdrawing the needle from the article.

Use of such apparatus provides a more reliable way to feed individual washers and tufts to an automatic insertion needle. The ability to feed individual tufts and washers from a plurality of connected tufts and a plurality of connected washers greatly increases the speed and efficiency of the overall tufting process.

According to a fifth aspect of the present invention there is provided a method for the automatic insertion of an individual upholstery tuft and washer into an upholstered article comprising the steps of, feeding a plurality of connected tufts and a plurality of connected washers to a tuft insertion needle, actuation of first tuft engagement means to move from a rest position clear of the needle to engage a leading tuft and move to an insertion position where it inserts the leading tuft into the tuft insertion needle, actuation of a washer separator to separate a leading washer from the plurality of connected washers, actuation of a tuft separator to separate the leading tuft from the plurality of connected tufts, and driving the insertion needle and associated tuft through the separated leading washer, into the upholstered article, releasing the tuft from the needle and subsequently withdrawing the needle from the article.

Preferably the distance between the rest and insertion positions of the first tuft engagement means is adjustable. In this way, the apparatus can be adjusted to accommodate tufts of different lengths. The tuft separator is preferably actuated by the first engagement means returning to its rest position following insertion of a tuft into the insertion needle. The tuft separator may have a cutting blade.

Preferably the apparatus has a second tuft engagement means for advancing the plurality of connected tufts into position for separation of a further leading tuft. The second engagement means is preferably actuated to advance the connected tufts by the first engagement means returning to its rest position following insertion of a tuft into the insertion needle. The first and second engagement means are preferably rotatably movable. The second engagement means may have first and second cammed surfaces of different radii with which a section of the first engagement means interacts to actuate the second engagement means.

Preferably the washer separator is actuated by the first tuft engagement means moving from its rest position to its insertion position and may have a cutting blade. The plurality of connected tufts is preferably fed to the first engagement means via a straightener unit which ensures the connected tufts are correctly orientated for insertion into the insertion needle. Preferably the straightener unit comprises a tapered chute having at least one deflector located therein to deflect the connected tufts into the correct orientation. The, or each, deflector may be hemispherical in shape. The straightener unit may have a guide collar through which the connected tufts pass and may have a spring tensioner biased towards the connected tufts. Preferably the insertion needle and the first tuft engagement means are pneumatically actuated.

It is one object of the present invention to provide an improved automatic tufting method and apparatus therefor. Further objects, features, advantages, benefits, and aspects of the present invention will become apparent from the drawings and description contained herein.

DESCRIPTION OF THE ILLUSTRATED EMBODIMENTS

Figure 1:
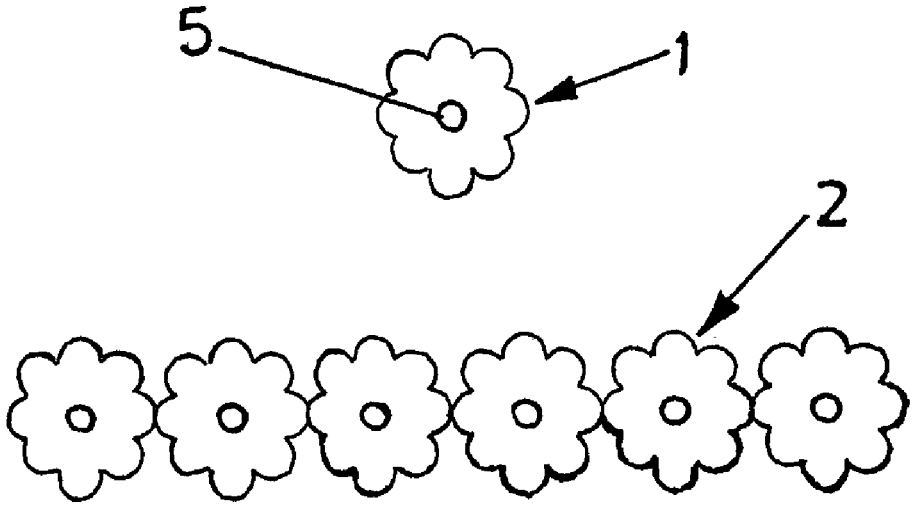
FIG. 1 is a front view of a plurality of connected washers to be used with the apparatus of the present invention.
Figure 2:
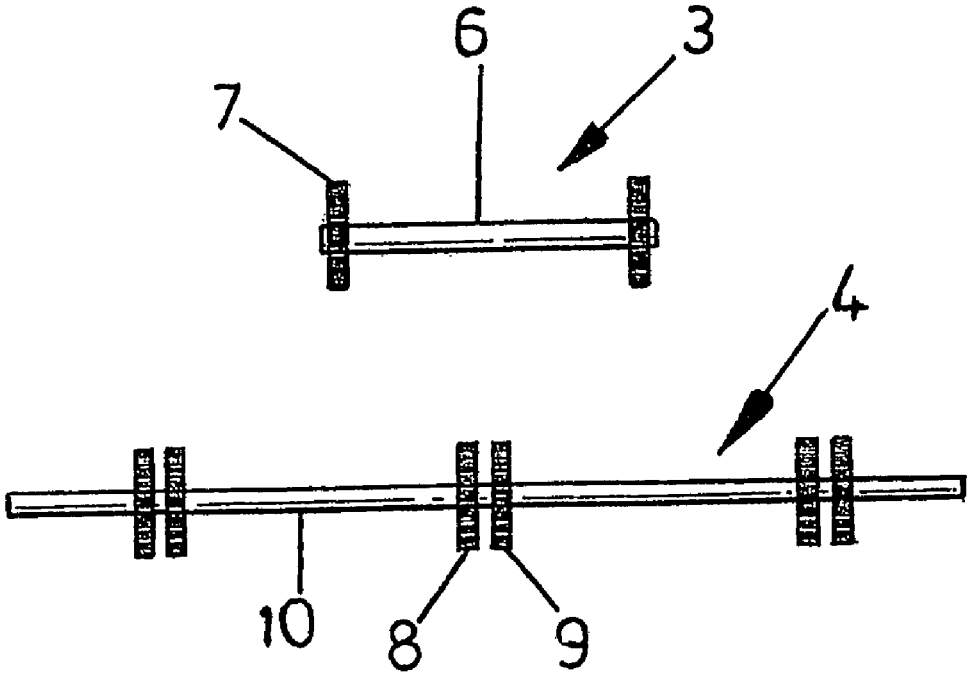
FIG. 2 is a plan view of a plurality of connected tufts to be used with the apparatus of the present invention.

Referring now to FIGS. 1 and 2, the apparatus of the present invention is designed to enable an individual washer 1 from a plurality of connected washers 2 and an individual tuft 3 from a plurality of connected tufts 4 to be inserted into an upholstered article (not shown). The washers 2 are stamped out of a sheet of soft, compressible felt material so as to be integrally connected in a side-by-side fashion to form a continuous string to be fed to the apparatus. Each washer has a central aperture 5 for receipt of the tuft 3. Each tuft 3 comprises an elongate flexible element 6, such as a tape, cord or string, interconnecting a pair of toggles 7 manufactured from a more rigid material, such as nylon or other plastics material. Pairs of toggles 8, 9 are spaced apart along a continuous string 10 which is cut by the apparatus intermediate each pair of toggles 8, 9 to release the individual tuft 3. The tufts 4 are stored on a reel (not shown) which is unwound as tufts 4 are fed to the apparatus. The following description will be limited to tufting a mattress, however it will be obvious to those skilled in the art that the present invention is applicable to the tufting of any upholstered article.

Figure 3:
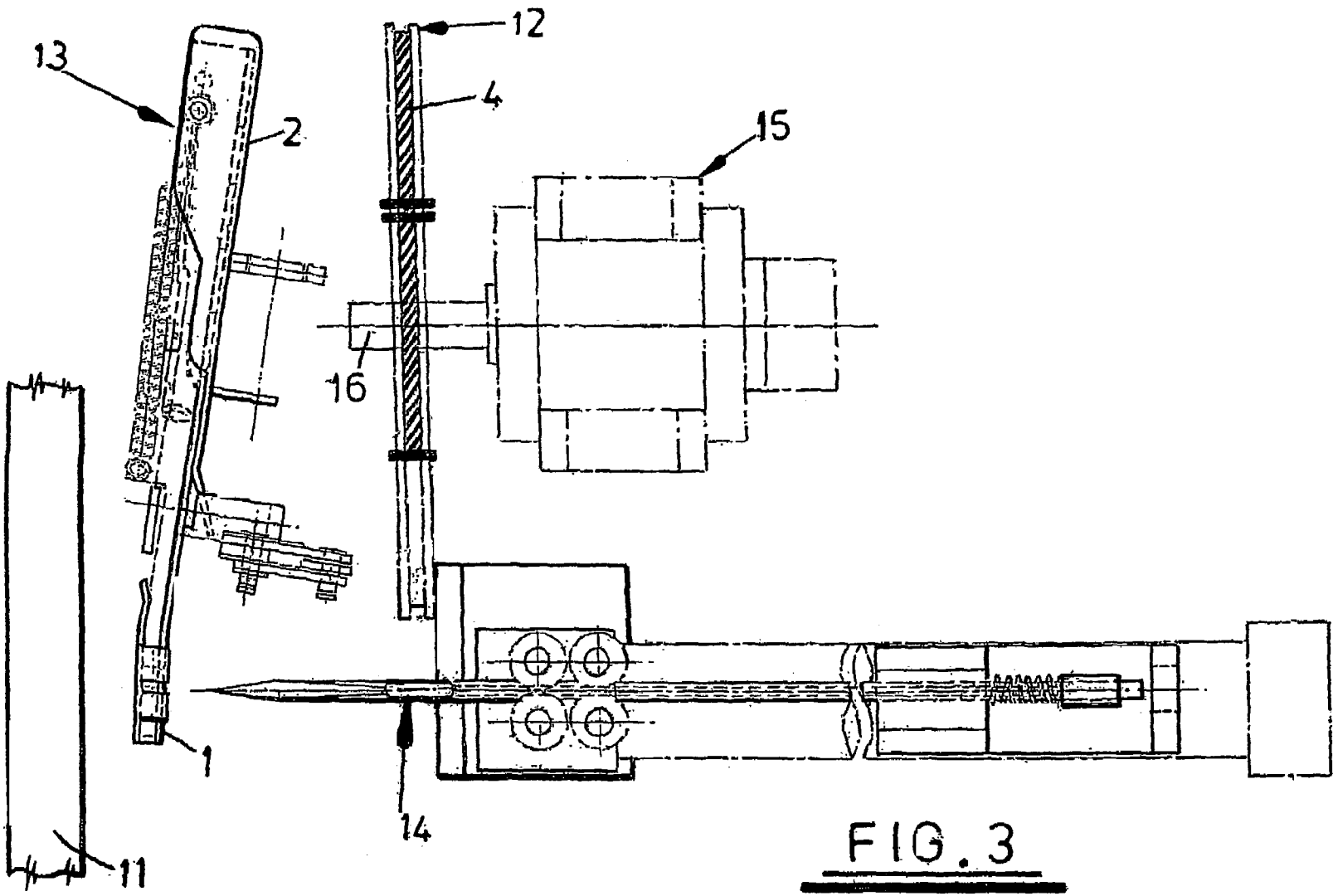
FIG. 3 is a schematic plan view of the apparatus of the present invention.
Figure 4:
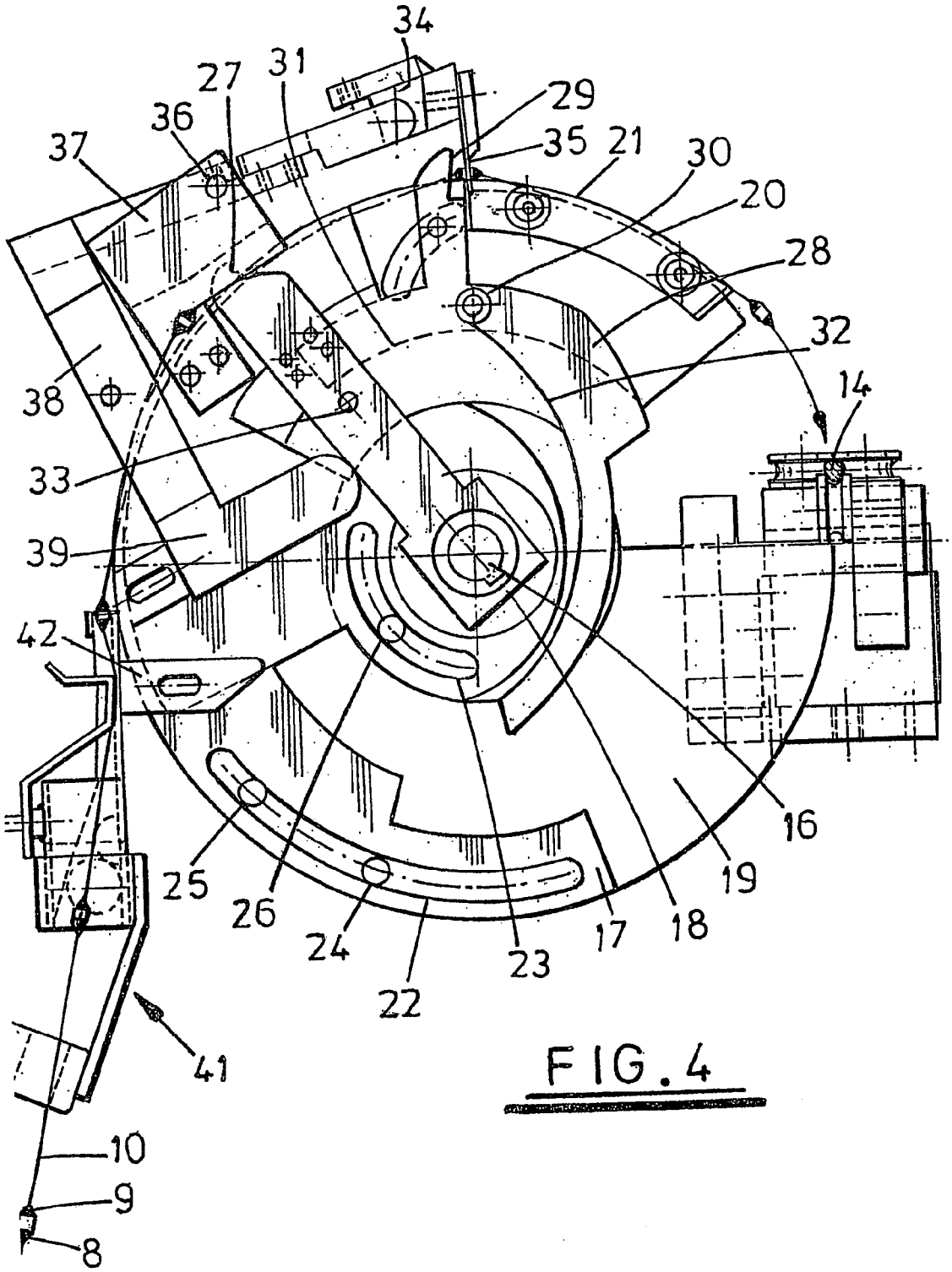
FIG. 4 is a front view of the apparatus of FIG. 1 with a first pair of tuft indexing arms at its rest position and with washer feed means omitted.
Figure 5:
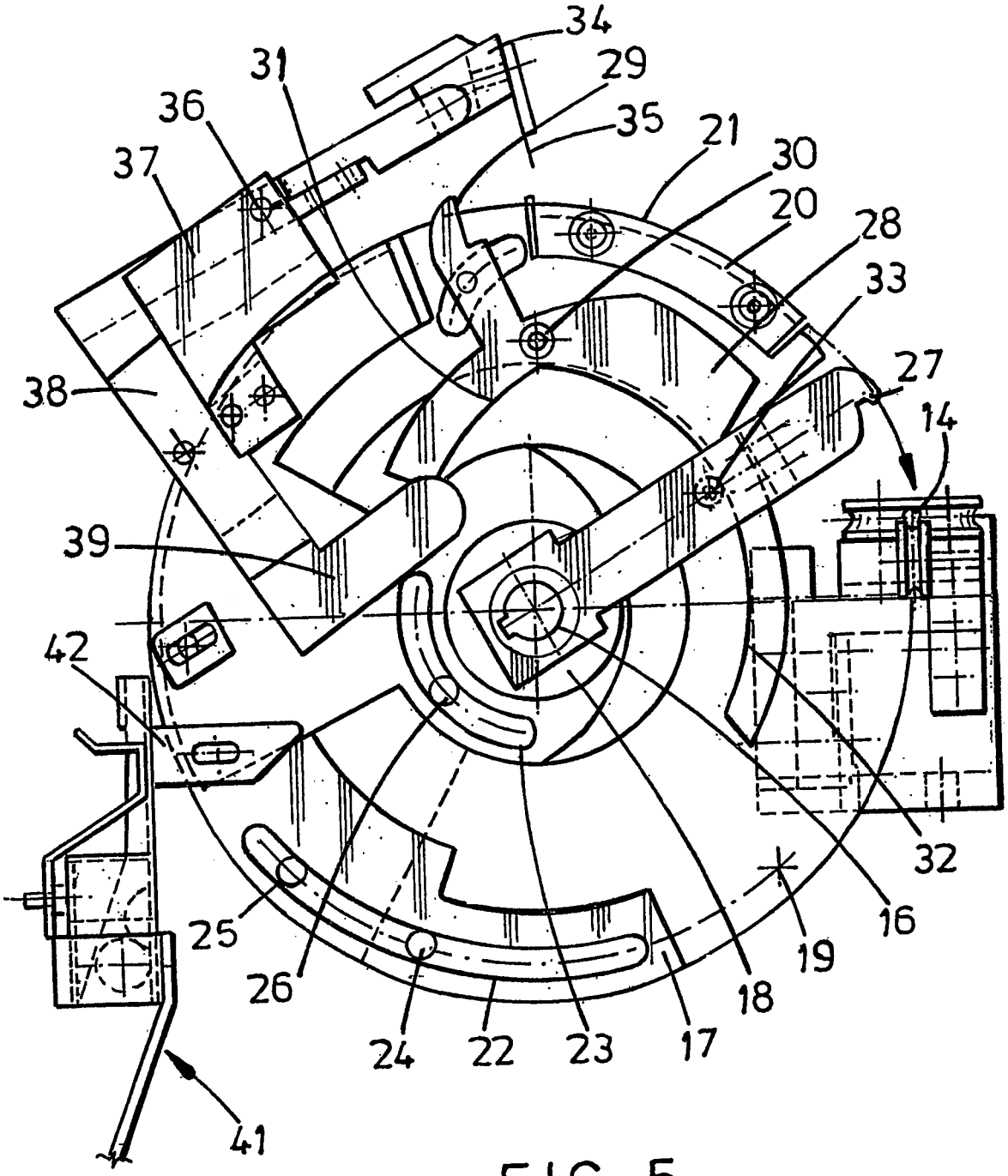
FIG. 5 is a front view of the apparatus of FIG. 1 during engagement of a tuft by the first pair of tuft indexing arms with washer feed means omitted.

Referring now to FIG. 3, the apparatus of the present invention has three main constituent units which interact to insert the tuft 3 and washer 1 into a mattress 11. The three main units are: a tuft feed unit 12; a washer feed unit 13; and an insertion needle 14. The tuft feed unit 12 feeds and inserts individual tufts 3 from the plurality of tufts 4 into the insertion needle 14. The tuft feed unit 12 is driven by a rotary actuator 15 via a rotary drive shaft 16. The washer feed unit 13 feeds individual washers 1 from the plurality of washers 2 and aligns each one in turn with the insertion needle 14. Once the leading tuft 3 of the plurality of tufts 4 has been loaded into the needle 14 it is separated from its neighboring tuft and the needle 14 then driven through the washer 1 and into the mattress 11.

FIGS. 4 to 7 show the tuft feed unit 12 in greater detail. A first set of generally arcuate plates 17 are rotatably disposed on a central boss 18 which is in turn connected to a second set of fixed generally arcuate plates 19. As the plurality of tufts 4 is fed over the first set of plates 17 the tuft string 10 is received in a peripheral groove 20 formed between a pair of outer raised walls 21. During feeding of the tufts 4, the toggles 8, 9 ride over the raised walls 21.

The first set of plates 17 have a pair of arcuate slots 22, 23 which ride over fixing pins 24, 25, 26 which are connected to the second set of plates 19. The fixing pins 24, 25, 26 can be loosened and re-tightened to allow the rotational displacement of the first set of plates 17 relative to the second set of plates 19 to be fixed at any angle within a range permitted by the length of the slots 22, 23. Adjustment of the rotational displacement between the two sets of plates 17, 19 allows the distance between rest and insertion positions of a first pair of tuft indexing arms 27 (described below) to be adjusted, thus enabling tufts of different lengths to be used with the apparatus.

The first pair of tuft indexing arms 27 is rotatably disposed on the shaft 16, one on each side of the first set of plates 17. Each arm has a tuft engaging recess near its radially outer tip, the tip projecting radially just beyond the periphery of the walls 21. A second pair of tuft indexing arms 28, with tuft engaging recesses 29 near their radially outer tip projecting radially just beyond the periphery of the walls 21, project from the first set of plates 17. The second pair of arms 28 are located axially intermediate the first pair of arms 27 and first set of plates 17. The second pair of arms 28 are pivotally mounted on the first set of plates 17 about a pin 30 and have first and second cammed radially inner surfaces 31, 32 of different radii which interact with a pin 33 connected to the first pair of arms 27.

Figure 6:
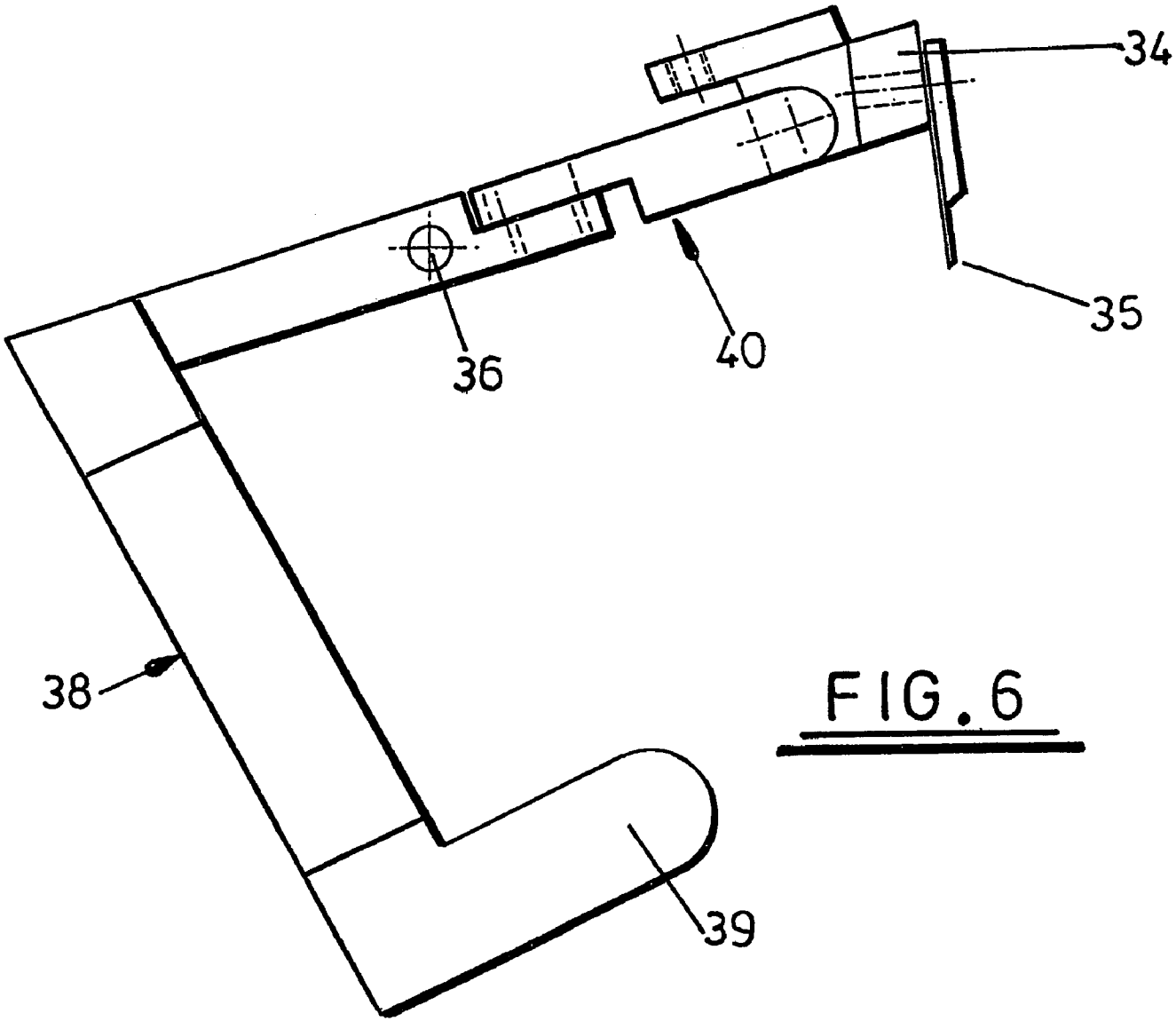
FIG. 6 is a front view of a tuft separator forming part of the present invention.
Figure 7:
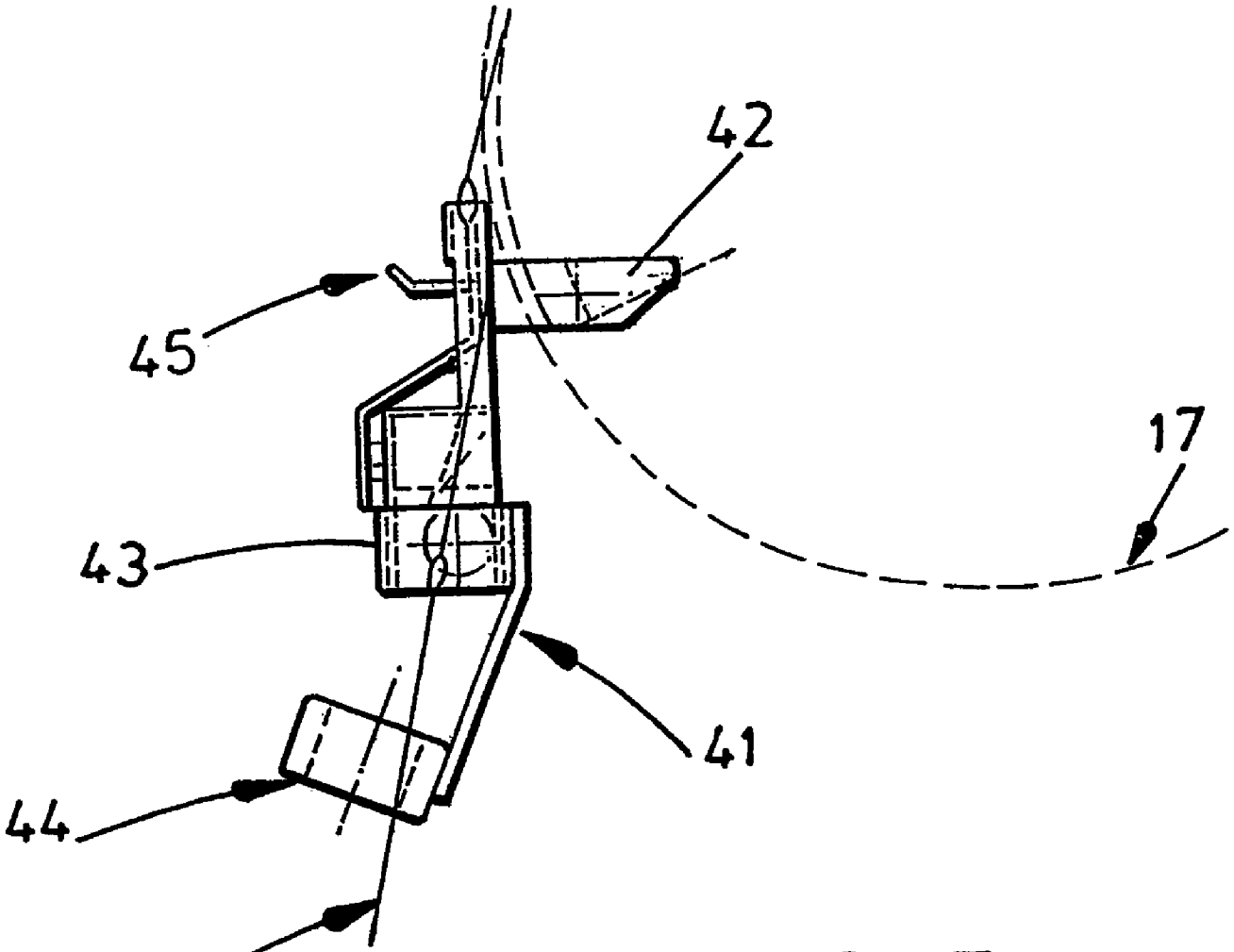
FIG. 7 is a front view of tuft straightener unit of the present invention.

A cutter arm 34 having a cutter blade 35 at its tip is pivotally mounted on the first set of plates 17 by a pivot pin 36 received in a bracket 37 which is fixed at the periphery of the first set of plates 17. The cutter arm 34 is pivoted by a radial lever 38 which has a perpendicular striking member 39. It is biased towards a rest position (shown in FIG. 5) by a torsion spring (not shown) but moves to its cutting position (shown in FIG. 4) when the striking member 39 is engaged by the first pair of tuft indexing arms 27. FIG. 6 shows the cutter arm 34 and blade 35 in isolation. The effective length of the cutter arm 34 can be adjusted by movement of a connecting bar 40, thus allowing the location at which the blade 35 cuts the tuft string 10 to be precisely controlled.

For the tufting process to operate efficiently it is important that the leading tuft 3 is presented to the first and second pairs of arms 27, 28 in the correct orientation for loading onto the insertion needle 14. This is achieved by a straightener unit 41 (shown in more detail in FIG. 7). The straightener unit 41 is mounted on the first set of arcuate plates 17 by a bracket 42 and has three components: a tapered chute 43 with three hemispherical deflectors located therein; a guide collar 44 located below the chute 43; and an adjustable spring tensioner plate 45 disposed above the chute 43 and biased towards the tuft string 10 in order to tension the string 10.

Figure 8A:
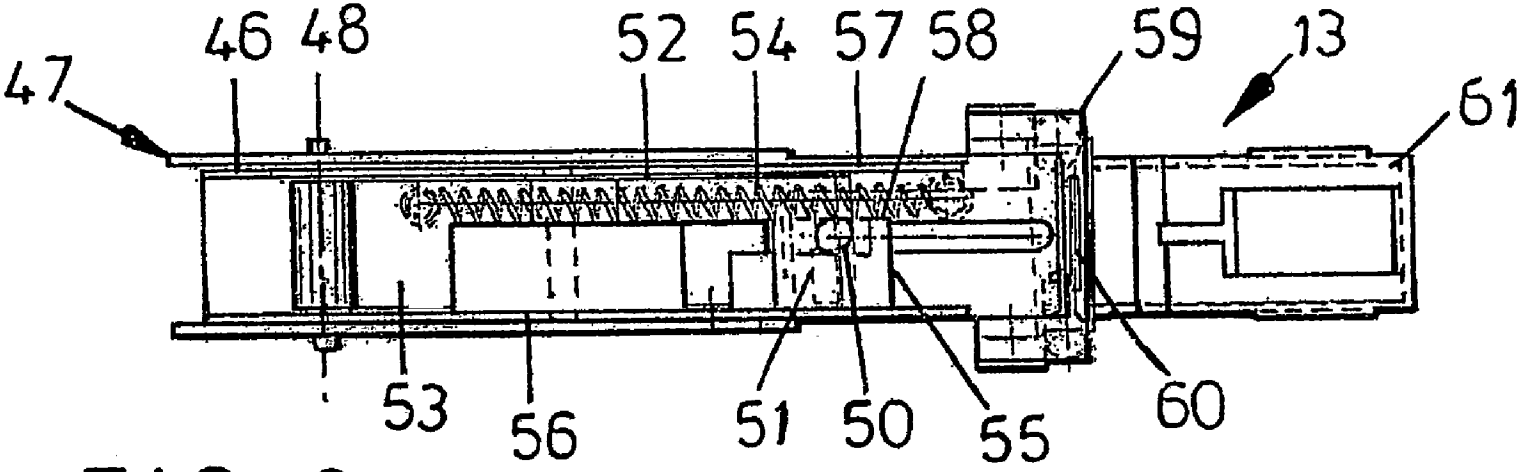
FIG. 8*a* is a front view of the washer feed unit of the present invention.
Figure 8B:
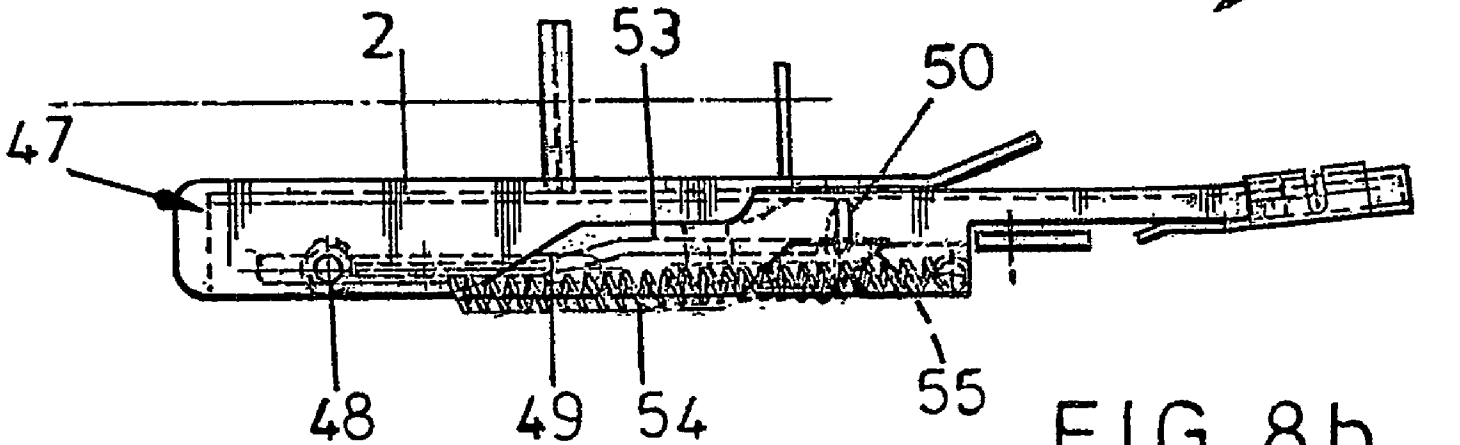
FIG. 8*b* is a plan view of the washer feed unit of FIG. 8*a*.

Referring now to FIGS. 8*a* and 8*b*, the washer feed unit has a pair of nested channel-shaped guide members 46, 47 which are fixed to the second set of arcuate plates 19 and which house the continuous string of washers 2 (omitted from FIG. 8*a* for clarity). Outer member 47 is slidably received on fixed inner member 46. A pivot pin 48 is connected to the outer member 47 and received in a slot 49 in inner member 46 so as to permit reciprocating linear movement of the outer member 47 over the inner member 46.

A washer engagement pin 50 is mounted on a vertical limb 51 which depends from a thinner horizontal section 52 of an inverted L-shaped connecting arm 53. The connecting arm 53 is pivotally connected to the outer member 47 at pivot pin 48. The washer engagement pin 50 is shaped to fit into the aperture 5 in the center of a washer 1. When the leading washer 1 is to be fed to the insertion needle 14 the string of washers 2 is indexed towards the needle 14 by movement of the outer member 47 over the inner member 46, driven by a pneumatic actuator (not shown). Once the washers 2 have been indexed towards the needle 14 the biasing force of a spring 54 which connects the two members 46, 47 is used to pull the outer member 47 away from the needle 14.

Following indexing the engagement pin 50 is released from the washers 2 and then returns back to the correct position to immediately locate in the aperture 5 of the next washer in the string 2 for subsequent indexing. This is achieved by limiting the relative linear displacement of the two members 46, 47 to that of the width of a washer 1 and by ensuring the pin 50 is not in contact with the string of washers 2 as it is pulled away from the needle 14. The pin 50 is prevented from engaging washers 2 whilst being pulled away from the needle 14 by passing over the forward facing surface of a ramp 55. The ramp 55 is fixed to a bottom panel 56 of the inner member 46 leaving a clearance between an upper panel 57 of the inner member 46 and an upper surface 58 of the ramp 55. The clearance is of sufficient size to allow the horizontal section 52 of the connecting arm 53 to pass therethrough as the connecting arm 53 pivots forwards away from the washers 2 following release of the pin 50 from the washer 1. The pin 50 then engages the inclined leading surface of the ramp 55. Action of the pneumatic actuator on the outer member 47 then causes the pin 50 to pass up and over a first section of the forward facing surface of the ramp 55 and pass along a horizontal recess in the ramp 55 before dropping back down into the correct position behind the ramp 55.

A washer separator unit 59 is positioned towards the ends of the guide members 46, 47 nearest the needle 14. The separator unit 59 has a slot 60 for passage of a cutting blade (shown in FIG. 9) therethrough. As the washers 2 are indexed the leading washer 1 is fed towards a stop 61 which supports the washer in alignment with the needle 14 ready for insertion into the mattress 11.

Figure 9:
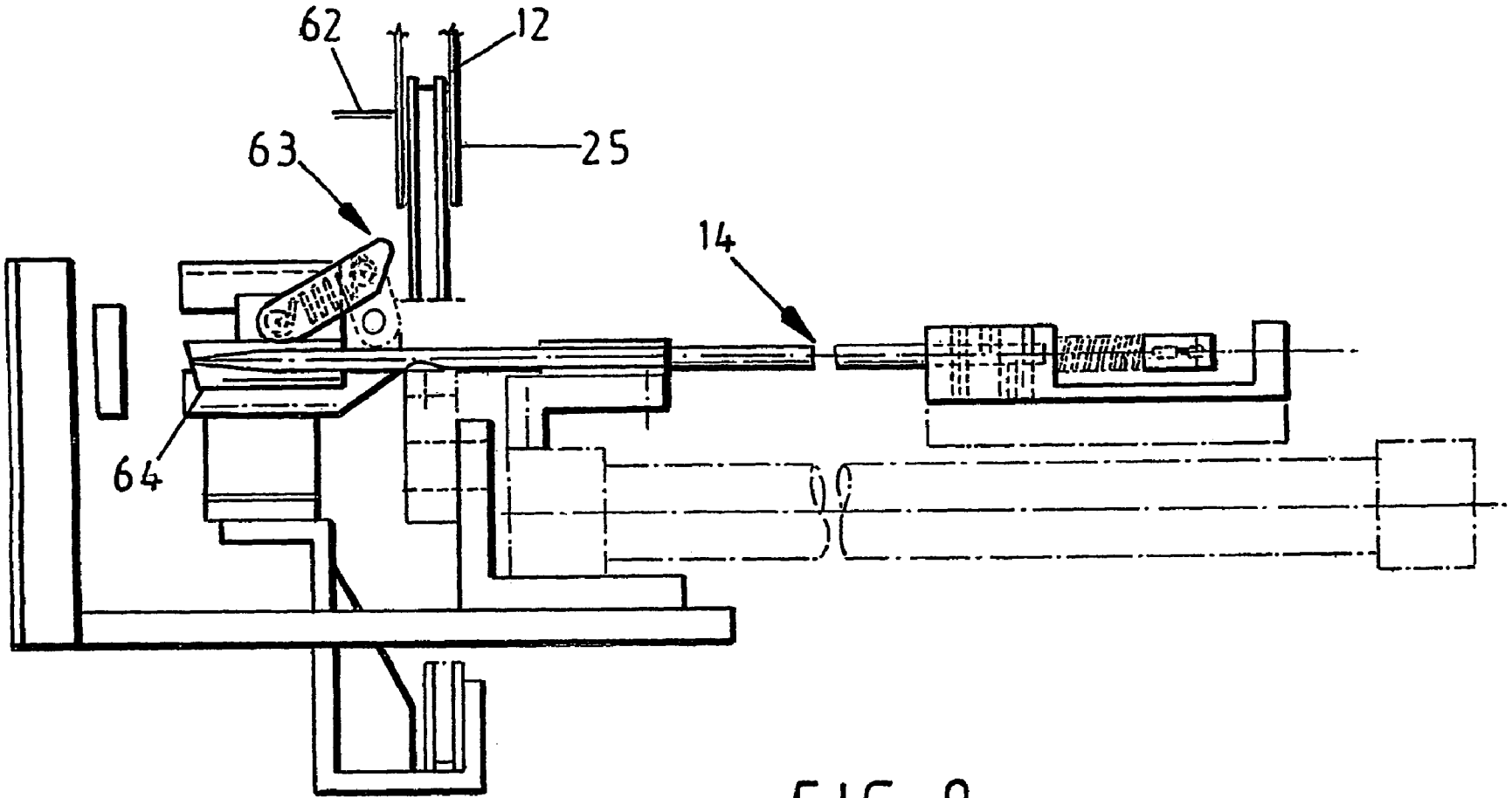
FIG. 9 is a side view of the apparatus of FIG. 3.

FIG. 9 illustrates the way in which tuft feed unit 12 interacts with the washer feed unit 13 to separate the leading washer I from the string of washers 2. A forward projecting striking plate 62 is connected to the first pair of tuft indexing arms 27 and interacts with a linkage mechanism 63 to force a washer cutting blade 64 through the washers 2 releasing the leading washer 1 from the string 2.

A tufting cycle will now be described with reference to all of the above-described Figures. An operator initiates the tufting process by depressing a button adjacent the apparatus. A signal is sent to a pneumatic actuator to rotate the first pair of tuft engaging arms 27 relative to the first set of arcuate plates 17. The arms 27 rotate in a clockwise direction from their rest position to engage the leading tuft toggle 7 on the string 10. Movement of the arms 27 in this direction releases cutter arm 34 which returns to its rest position and raises cutter blade 35 from the string of tufts 10. Simultaneously, an actuator is operated to slide the outer member 47 of the washer feed unit 13 over the inner member 46, thus indexing the string of washers 2 towards the insertion needle 14 as described above. It is assumed that the leading washer has already been separated from the string of washers in a preceding cycle.

The pin 33 connected to the first pair of arms 27 now interacts with the cammed surface 32 of the second pair of arms 28. This interaction causes the second pair of arms 28 to pivot anti-clockwise about pin 30 ready to engage the next tuft in the string 10. As arms 27 rotate clockwise striking plate 62 engages with linkage mechanism 63 to actuate the cutting blade 64 to cut the string of washers 2 separating the next, as yet unseparated, leading washer from the string ready for a subsequent tufting cycle.

The arms 27 then load the tuft into a cavity in the insertion needle 14. The construction of the insertion needle has not been described in detail since it corresponds to a conventional needle with which the man skilled in the art would be familiar. The needle 14 used in this apparatus differs from a manually operated needle only in the fact that it is pneumatically actuated to penetrate and retract from the mattress 11.

A signal is then received by the arms 27 to rotate anti-clockwise and return to their rest position. The spring 54 then pulls the outer member 47 away from the needle 14 to disengage the pin 50 from the washers 2 and locate it in the aperture 5 in the next washer in the string. Movement of the arms 27 releases plate 62 from linkage mechanism 63 and in turn washer cutting blade 64 is released from the string of washers 2. Release of pin 33 from cammed surface 32 and into contact with cammed surface 31 allows the second set of arms 28 to rotate clockwise about pin 30 to advance the string of tufts 10 ahead of arms 27 ready for the next cycle. Rotation of arms 27 to their rest position causes them to interact with cutter arm 34 to bring cutter blade 35 down onto the string 10 and release the leading tuft 3 (which is currently loaded into the needle 14) from the string 10.

The operator then depresses a second button to send a signal to a further pneumatic actuator to insert the needle 14 and associated tuft 3 through the aligned washer 1 and into the mattress 11. The washer 1 is forced against the rear face of the mattress 11. Once the tuft 3 has passed through to the front face of the mattress 11, the toggle 7 is released from the needle 14 and the pump is then actuated to withdraw the needle 14 from the mattress 11.

It will be understood that numerous modifications can be made to the embodiment of the invention described above without departing from the underlying inventive concept and that these modifications are intended to be included within the scope of the invention. For example, the washers, strings and toggles can be manufactured from any suitable material and may be of any size to suit the present application.

The apparatus of the present invention can be hand-held and operated by a single worker walking round the mattress. Alternatively, to increase the automation of the tufting process, the apparatus is located on a track supported on a frame. The frame is constructed in the form of a bridge designed to enable a mattress to be passed on a conveyor under the track. The track is arranged so that as the apparatus is indexed along the track it inserts tufts in a line across the mattress. The track is orientated perpendicular to the direction of travel of the mattress along the conveyor so that a series of lines of tufts can be inserted into the mattress by indexing the conveyor.

In order to increase the automation of the tufting process still further, a second track, in line with the one on which the tufting apparatus is located, is positioned on the opposite side of the mattress to the tufting apparatus. Further washer feeding apparatus is located on the second track and indexed therealong in register with the tufting apparatus. In this way, a further individual washer can be received on the needle holding the tuft as it exits the front face of the mattress. As the needle is subsequently withdrawn and the tuft released a washer is then provided intermediate the toggle and the outer surface of mattress on the front face of the mattress as well as the rear face. It will also be obvious to the skilled man that this apparatus does not have to be controlled by the manual actuation of buttons adjacent the apparatus, it is equally well suited to a more automated computer controlled actuation process.

What is claimed is:

1. An apparatus for automatically feeding an individual upholstery washer to upholstery tufting apparatus comprising, a washer guide along which a plurality of connected washers can be fed towards a tuft insertion needle of the tufting apparatus, washer engagement means to engage at least one of the connected washers, feed the washers along the guide and align a leading washer with the insertion needle, and a washer separator to separate the leading washer from the plurality of connected washers.

2. Apparatus according to claim 1, wherein the washer separating means has a cutting blade.

3. Apparatus according to claim 1, wherein the washer separating means is actuated by the tufting apparatus.

4. Apparatus according to claim 1, wherein the washer engagement means has at least one projection to engage at least one of the connected washers.

5. Apparatus according to claim 4, wherein the or each projection is received in an aperture in one of the connected washers.

6. Apparatus according to claim 1, wherein the washer guide comprises a first member slidably received on a second member.

7. Apparatus according to claim 6, wherein the washer engagement means is connected to the first member such that sliding of the first member over the second member towards the insertion needle causes the plurality of connected washers to be fed along the washer guide towards the insertion needle.

8. Apparatus according to claim 7, wherein the washer engagement means is pivotally connected to the first member.

9. Apparatus according to claim 7, wherein the second member has a ramp over which the washer engagement means passes when the first member slides over the second member away from the insertion needle.

10. Apparatus according to claim 7, wherein the first member is connected to the second member by biasing means which biases the first member away from the insertion needle.

11. Apparatus according to claim 7, wherein sliding of the first member over the second member towards the insertion needle is pneumatically actuated.

12. Apparatus according to claim 1, wherein the insertion needle is pneumatically actuated.

13. Apparatus according to claim 1, wherein the tufting apparatus is pneumatically actuated.

14. A plurality of upholstery washers for use with upholstery tufting apparatus, wherein each washer is connected to at least one further washer in a side-by-side fashion.

15. A plurality of upholstery washers according to claim 14, wherein each washer is integrally connected to at least one further washer.

16. A plurality of upholstery washers according to claim 14, wherein the washers are made from a compressible material.

17. A plurality of upholstery washers according to claim 14, wherein the washers are made from a felt material.

18. A plurality of upholstery washers according to claim 14, wherein at least one washer has an aperture for receipt of an upholstery tuft.

19. Method for automatically feeding an individual upholstery washer to upholstery tufting apparatus comprising the steps of, providing a plurality of connected washers, engaging at least one of the plurality of connected washers in a washer guide with washer engagement means, feeding the connected washers along the washer guide towards an insertion needle of the upholstery tufting apparatus, aligning a leading washer with the insertion needle, and separating the leading washer from the plurality of connected washers.

20. Apparatus for the automatic insertion of an individual upholstery tuft and washer comprising, means for feeding a plurality of connected tufts and means for feeding a plurality of connected washers, first tuft engagement means to engage a leading tuft and feed it to a tuft insertion needle, the first engagement means being reversibly movable from a rest position clear of the needle and an insertion position where it inserts the leading tuft into the insertion needle, a washer separator for separating a leading washer from the plurality of connected washers, a tuft separator for separating the leading tuft from the plurality of connected tufts, and means for driving the insertion needle and associated tuft through the separated leading washer, into the upholstered article, releasing the tuft from the needle and subsequently withdrawing the needle from the article.

21. Apparatus according to claim 20, wherein the distance between the rest and insertion positions of the first tuft engagement means is adjustable.

22. Apparatus according to claim 20, wherein the tuft separator is actuated by the first engagement means returning to its rest position following insertion of a tuft into the insertion needle.

23. Apparatus according to claim 20, wherein the tuft separator has a cutting blade.

24. Apparatus according to claim 20, wherein the apparatus has a second tuft engagement means for advancing the plurality of connected tufts into position for separation of a further leading tuft.

25. Apparatus according to claim 24, wherein the second engagement means is actuated to advance the connected tufts by the first engagement means returning to its rest position following insertion of a tuft into the insertion needle.

26. Apparatus according to claim 24, wherein the first and second engagement means are rotatably movable.

27. Apparatus according to claim 26, wherein the second engagement means has first and second cammed surfaces of different radii with which a section of the first engagement means interacts to actuate the second engagement means.

28. Apparatus according to claim 20, wherein the washer separator is actuated by the first tuft engagement means moving from its rest position to its insertion position.

29. Apparatus according to claim 20, wherein the plurality of connected tufts is fed to the first engagement means via a straightener unit which ensures the connected tufts are correctly orientated for feeding to the insertion needle.

30. Apparatus according to claim 29, wherein the straightener unit comprises a tapered chute having at least one deflector located therein to deflect the connected tufts into the correct orientation.

31. Apparatus according to claim 30, wherein the at least one deflector is hemispherical in shape.

32. Apparatus according to claim 29, wherein the straightener unit has a guide collar through whit the connected tufts pass.

33. Apparatus according to claim 29, wherein the straightener unit has a spring tensioner biased towards the connected tufts.

34. Apparatus according to claim 20, wherein the automatic washer feed apparatus is in accordance with claim 1.

35. Apparatus according to claim 20, wherein the insertion needle is pneumatically actuated.

36. Apparatus according to claim 20, wherein the first tuft engagement means is pneumatically actuated.

37. A method for the automatic insertion of an individual upholstery tuft and washer into an upholstered article comprising the steps of, feeding a plurality of connected tufts and a plurality of connected washers, actuation of first tuft engagement means to move from a rest position clear of the needle to engage a leading tuft and move to an insertion position where it inserts the leading tuft into a tuft insertion needle, actuation of a washer separator to separate a leading washer from the plurality of connected washers, actuation of a tuft separator to separate the leading tuft from the plurality of connected tufts, and actuation of means for driving the insertion needle and associated tuft through the separated leading washer, into the upholstered article, releasing the tuft from the needle and subsequently withdrawing the needle from the article.

* * * * *

UNITED STATES PATENT AND TRADEMARK OFFICE

CERTIFICATE OF CORRECTION

PATENT NO. : 7,191,716 B2
APPLICATION NO. : 10/918126
DATED : March 20, 2007
INVENTOR(S) : Dixon et al.

It is certified that error appears in the above-identified patent and that said Letters Patent is hereby corrected as shown below:

On the Title page of the patent, please insert and delete

Item (30), Foreign Application Priority Data: please insert
--Feb. 7, 2003 PCT/GB03/00573--

Item (56), References Cited
Delete "6,804,940 B2* 10/2004"

Signed and Sealed this

Tenth Day of July, 2007

JON W. DUDAS
*Director of the United States Patent and Trademark Office*

UNITED STATES PATENT AND TRADEMARK OFFICE

CERTIFICATE OF CORRECTION

PATENT NO. : 7,191,716 B2
APPLICATION NO. : 10/918126
DATED : March 20, 2007
INVENTOR(S) : Dixon et al.

It is certified that error appears in the above-identified patent and that said Letters Patent is hereby corrected as shown below:

On the Title page of the patent, please insert:

Item (73), Assignee
--Mattress Production Technology Group Limited--

Signed and Sealed this

Fifteenth Day of April, 2008

JON W. DUDAS
*Director of the United States Patent and Trademark Office*